United States Patent [19]

Johnson

[11] 4,098,183

[45] Jul. 4, 1978

[54] IN-LINE PRINTING DEVICE

[75] Inventor: George Erick Johnson, Sausalito, Calif.

[73] Assignee: CPC International Inc., Englewood Cliffs, N.J.

[21] Appl. No.: 752,733

[22] Filed: Dec. 21, 1976

[51] Int. Cl.[2] ..... B41F 17/20

[52] U.S. Cl. ..... 101/40; 64/30 R; 101/DIG. 3

[58] Field of Search ..... 101/DIG. 3, 35, 39, 101/40, 233, 234, 235, 375, 376, 377; 64/30 R

[56] References Cited

U.S. PATENT DOCUMENTS

| | | | |
|---|---|---|---|
| 1,864,954 | 6/1932 | Stoll | 101/39 |
| 2,040,526 | 5/1936 | Mumma | 101/40 |
| 2,424,006 | 7/1947 | Verrinder | 101/376 X |
| 2,501,096 | 3/1950 | Robins et al. | 64/30 R UX |
| 2,525,379 | 10/1950 | Smilansky | 64/30 R |
| 2,716,941 | 9/1955 | Hattman | 101/DIG. 3 |
| 2,819,671 | 1/1958 | Porter, Jr. et al. | 101/DIG. 3 |
| 3,037,447 | 6/1962 | Gonzalez et al. | 101/235 X |
| 3,092,019 | 6/1963 | Van Buskirk | 101/DIG. 3 |
| 3,112,691 | 12/1963 | Worth | 101/35 |
| 3,208,375 | 9/1965 | Worth | 101/35 |
| 3,294,015 | 12/1966 | Gartside | 101/35 |
| 3,783,776 | 1/1974 | Noble et al. | 101/40 X |

FOREIGN PATENT DOCUMENTS

| | | | |
|---|---|---|---|
| 1,436,574 | 2/1969 | Fed. Rep. of Germany | 101/40 |

*Primary Examiner*—Clifford D. Crowder

[57] ABSTRACT

A printing device or coder particularly adaptable for printing data on each of a plurality of articles such as conveyed in a moving production line. The device comprises a holder for preselected type mounted on a rotatable shaft connected through a slip clutch and a drive means to a rotary power means. The drive means is also connected to an ink roll positioned near to the type holder shaft. A pawl, normally urged into engagement with a cam member, holds the type holder in one position as the holder's shaft is allowed to slip momentarily with the clutch and as the type engages an article being printed. Thereafter, a movable trigger disengages the pawl and cam member and releases the type holder, allowing it to rotate into contact with the ink roll during one revolution of the shaft prior to the next printing cycle.

6 Claims, 18 Drawing Figures

IN-LINE PRINTING DEVICE

This invention relates to a printing device or coder for printing preselected data on each of a plurality of articles. It is particularly adaptable for use in conjunction with a roll-on type labeling apparatus of a container line.

BACKGROUND OF THE INVENTION

In the production and packaging of many goods in containers such as jars and cans, particularly food products that have a limited shelf life, it is necessary to provide label information such as the date at which the goods may be considered as stale or unsaleable. Printing devices for providing such label information must be capable of continuous, rapid operation for long periods of time and with a high degree of reliability. Moreover, such printer devices or coders must provide a clear and highly readable impression on the production article label without smearing even though the production line is moving at a high rate of speed.

A general object of the present invention is to provide an in-line printing device that fulfills the aforesaid desired requirements.

Another object of the present invention is to provide a printing device or coder that is adaptable for either continuous operation on a conveying line of production articles or for intermittent operation on other articles that are temporarily positioned for printing adjacent to the device.

Another object of the present invention is to provide an in-line printing device that is comprised of a unique combination of elements having relatively low inertia characteristics, thereby making them capable of rapid acceleration and deceleration and allowing the device to operate efficiently at high speeds with minimum wear and vibration.

Another object of the present invention is to provide an in-line printing device wherein the printing type contacts an inking wheel between each printing cycle in such a manner that only a minimum amount of ink is used thereon so that smearing is avoided during printing and a clear imprint is provided even for relatively small type.

Yet another object of the present invention is to provide an in-line printing device which may be powered by a motor or some other driving power source that runs at a constant speed and yet wherein the printing is accomplished while the type remains momentarily motionless in a fixed predetermined position.

Another object of the present invention is to provide an in-line printing device which is particularly adapted for use with a roll-on type label application machine for jars or cans.

Still another object of the invention is to provide an in-line printing device which allows the use of a wide range of type forms and sizes, either flexible or rigid, including the use of relatively small type without the usual requirement of high application pressure.

BRIEF SUMMARY OF THE INVENTION

The above objects of the invention are accomplished by an in-line printer device particularly adaptable for installation on a container conveying line such as a roll-on label application apparatus but also adaptable for intermittent operation with other articles. Generally, it comprises a pair of parallel frame members supporting a rotatable shaft to which is attached a holder head for printing type located between the frame members. Fixed to the shaft outside of the frame members is a cam member with a radially extending arm having a flat radial stop surface for engaging a pawl. The latter pawl is fixed to another movable shaft supported by the frame members which is also connected to a trigger or actuator arm. When the printer is mounted for use with a container labeling apparatus, the trigger is engageable by a container being moved along the production line. The trigger shaft and thus its attached pawl is normally urged by suitable spring means into a position to engage the stop surface of the cam member and thereby retain the type holder in a stationary position as a container moves against the type to be printed. The type holder shaft is driven by a power means such as an electric motor through a slip clutch means which allows the power means to operate at a constant rate while also allowing the shaft to be momentarily stopped by engagement of the pawl with the stop surface of the cam member. Fixed to another shaft between the frame members is an ink supply wheel that is positioned so as to engage the type in its holder as it rotates around between each printing cycle.

In a conventional container production line including a roll-on label application apparatus, an in-line printer device according to the present invention is installed at a preselected location so that as each container rolls by that location the label will be printed in approximately the same area thereon for each container. An adjustable mounting device can be provided to properly position the printer with ease and rapidity. As each container moves against the type holder, the latter is held in its non-movable position with the pawl being held against the retaining stop surface of the cam member. When the trigger is engaged by a container, the pawl is moved away from the cam member, thereby releasing the type holder shaft and allowing the type to rotate against the ink wheel. When the ink wheel and the type holder are caused to rotate at the same speed, the type merely "kisses" the ink wheel to pick up sufficient ink for the next printing cycle. Thereafter, the type holder shaft continues rotating until the type holder arrives back at its printing position at which point the pawl again engages the stop surface of the cam member and stops the shaft, as the clutch momentarily slips during the next printing cycle. Thus, as a plurality of containers move continuously down a labeling line the type holder shaft is stopped momentarily to print each label and then is quickly rotated through a reinking pass at the ink wheel before printing the next label.

In an alternate installation, the printing device according to the invention may be mounted for forward and then backward movement during each printing cycle instead of being stationary. For this arrangement the trigger means is actuated by a suitable fixed release means as the device is retracted, but in all other respects it operates in the same manner.

Other objects, advantages and features of the invention will become apparent from the following detailed description of one embodiment thereof taken in conjunction with the accompanying drawings.

DETAILED DESCRIPTION OF EMBODIMENT

Figure 2:
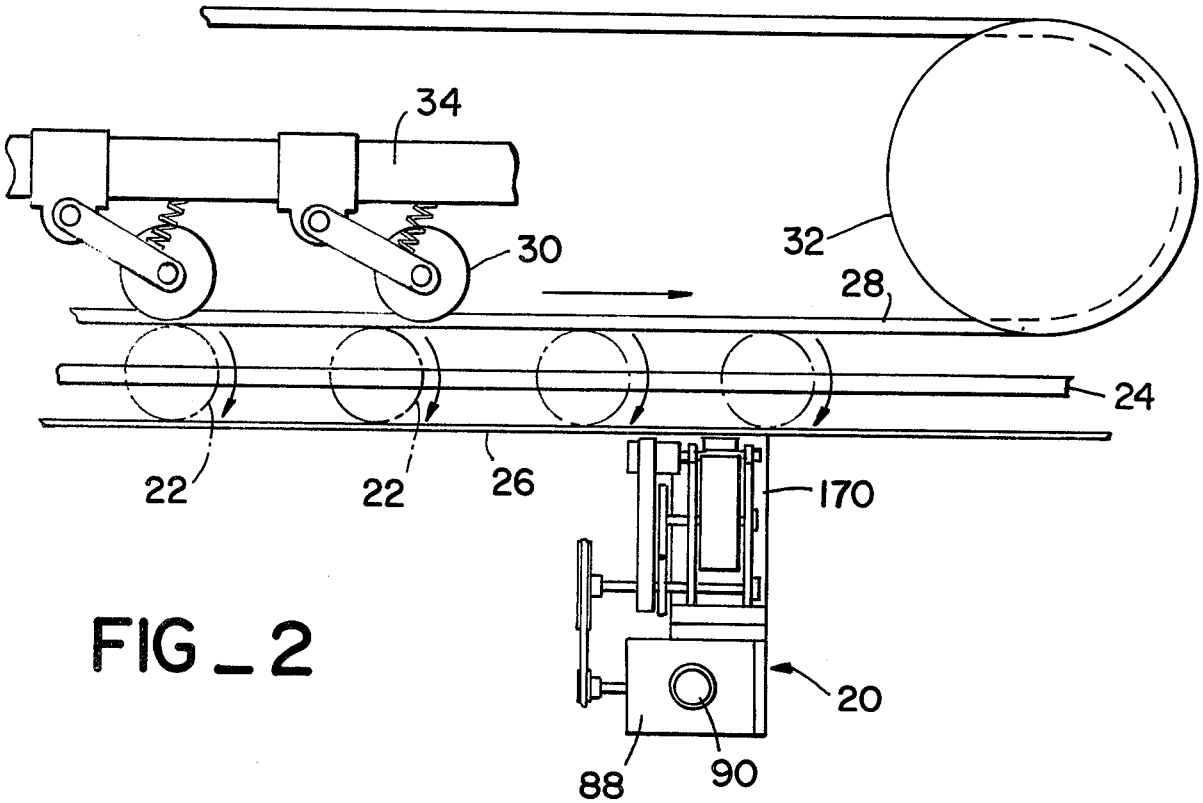
FIG. 2 is a plan view of the in-line printing device of FIG. 1, also showing a portion of the container labeling apparatus.
Figure 1:
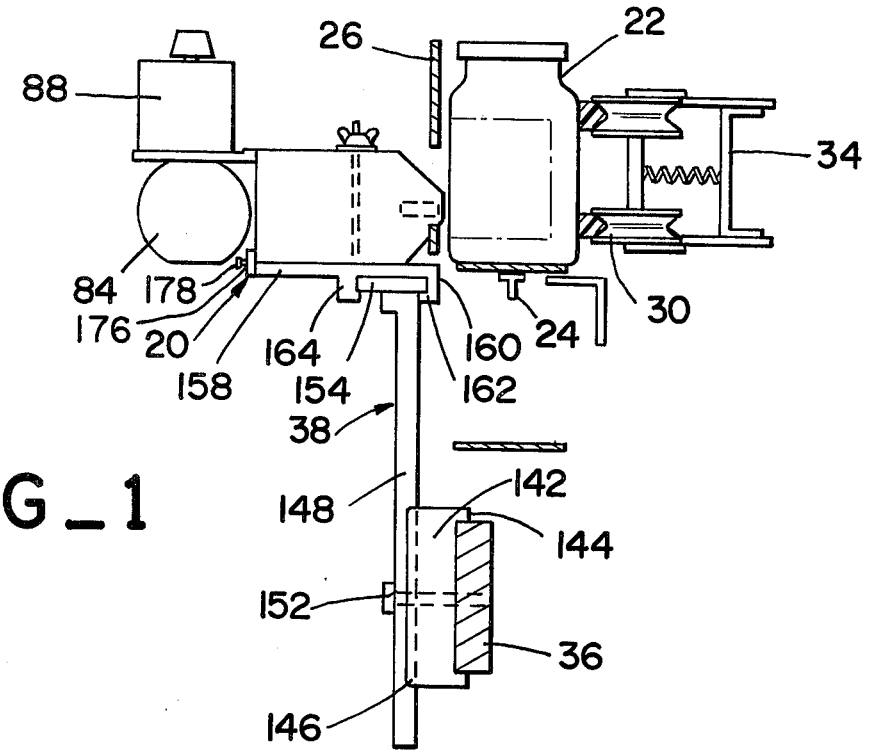
FIG. 1 is a view in elevation of an in-line printing device installed for use with a container labeling apparatus, a portion of which is shown.

With reference to the drawing, FIGS. 1 and 2 show an in-line printing or coder device 20 as it appears when installed on a container labeling apparatus. In a typical arrangement for such apparatus, filled containers 22 are moved along by a suitable conveyor chain 24 at a preselected rate as they are urged against a fixed barrier plate 26 by a side belt 28 and a series of spring loaded rollers 30. The side belt is driven by a pulley wheel 32 at a constant rate as the rollers, pivotally attached to a frame member 34, press the belt against the containers. This causes each container to roll along about its vertical axis as a label is applied to its outer cylindrical surface. The printing device 20 is attached to a structural frame member 36 of the apparatus at a preselected location downstream from the label application station and is positioned so that it will apply printed indicia such as date information to the same location on the label of each container. The precise position of the printer 20 relative to the conveying apparatus may be adjustable by means of a special mounting bracket assembly 38 which will be described in detail later on.

Figure 4:
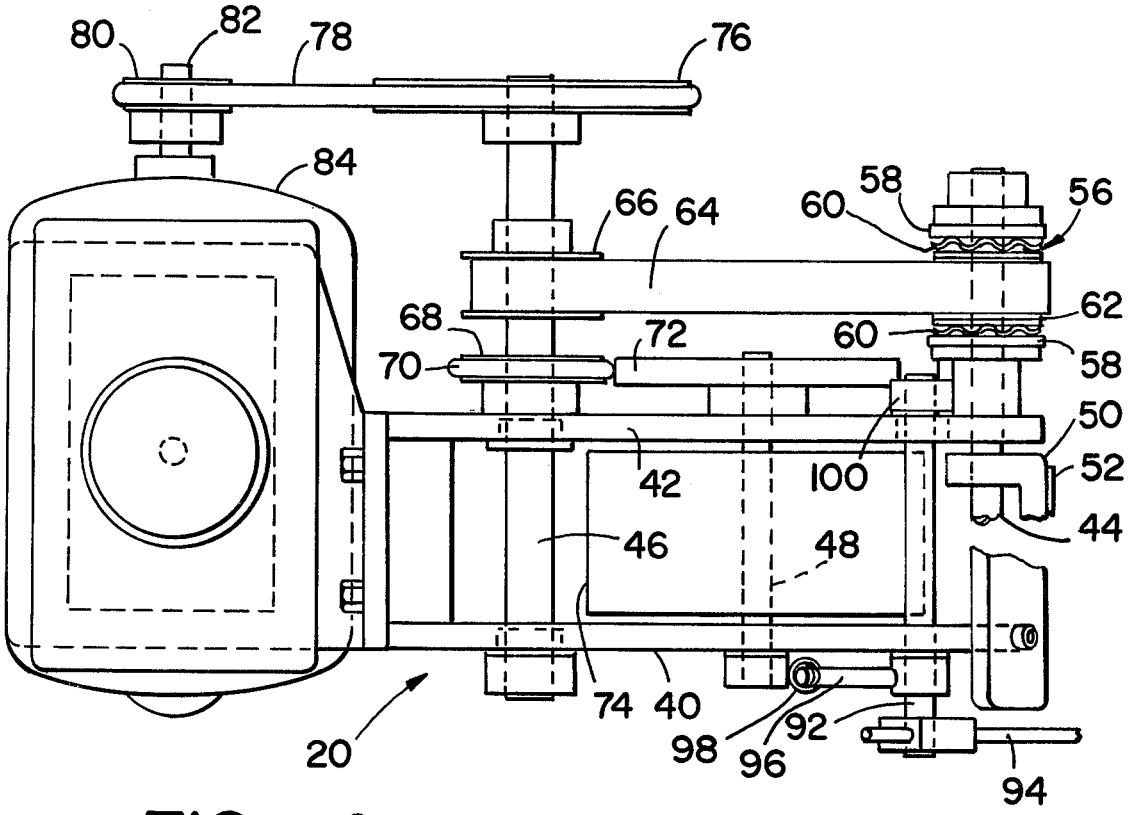
FIG. 4 is a plan view of the in-line printing device shown in FIG. 3.
Figure 3:
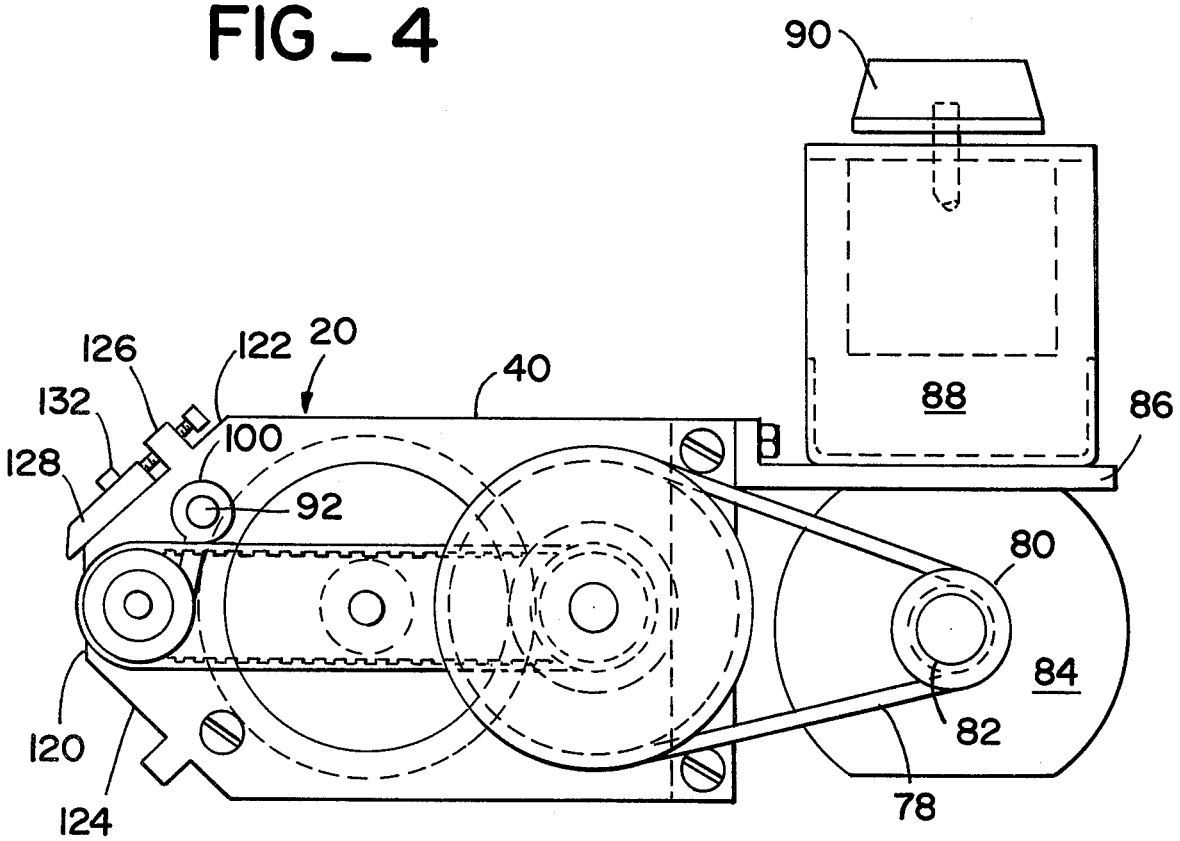
FIG. 3 is an enlarged and more detailed view in side elevation of an in-line printing device according to the present invention.

As shown in greater detail in FIGS. 3 and 4, the printer 20 comprises a pair of parallel, spaced apart frame plates 40 and 42, made of a suitable rigid material. Supported by and extending between these plates are three separate rotatable shafts 44, 46 and 48, whose axes are parallel and preferably located on or near the horizontal center lines of the frame plates. Fixed to the first shaft 44 nearest to the outer ends of and between the frame plates is a mounting block 50 that retains a replaceable preselected unit of printing type 52.

Figure 8:
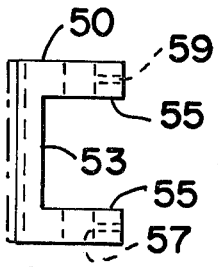
FIG. 8 is a plan view of the type holder.
Figure 7:
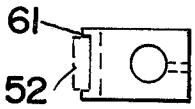
FIG. 7 is a view taken along line 7—7 of FIG. 5, showing the type holder.

As shown in detail in FIGS. 7, 8 this mounting block has an elongated body 53 that extends parallel to the shaft with arm portions 55 at right angles to the body having bore holes 57 through which the shaft extends. A set screw 59 in each arm portion holds it firmly to the shaft. The elongated body has a central recess with side edges 61 to receive and retain the block of type.

An extended portion of the first shaft 44 projects outwardly from the side of one frame plate 42 and fixed thereto for rotation with the shaft is a generally circular cam member 54. Also on the shaft 44 is a slip clutch unit 56 comprised of a pair of friction discs 58 that bear against wafer springs 60 on opposite sides of a slotted pulley 62. Extending around the pulley 62 is a flexible belt 64 that also extends around a second and slightly larger pulley 66 fixed to the second shaft 46. Preferably, the belt has spaced apart integral lugs that fit within peripheral teeth on the two pulleys 62 and 66 so that no slippage of the belt can occur. Adjacent to the second pulley on the second shaft is a grooved wheel 68 within which is seated an annular rubber ring 70 which is in tangential contact with a larger circular wheel 72 fixed to the outer end of the third shaft 48. Fixed to this third shaft between the frame plates is an ink supply wheel 74.

On the outer end of the second shaft 46 is another grooved wheel 76 which is connected by a flexible drive belt 78 to a smaller pulley 80 on the output shaft 82 of a power means such as an electric motor 84. The power means could also be a power takeoff from the adjacent labeling or conveying apparatus itself or some other convenient power output. In the embodiment shown, the motor is attached to and extends below a mounting plate 86 connected to the frame plates. Attached to this same mounting plate and extending above it is an electrical speed control unit 88 having a readily accessible control knob 90 on its upper side.

Figure 6:
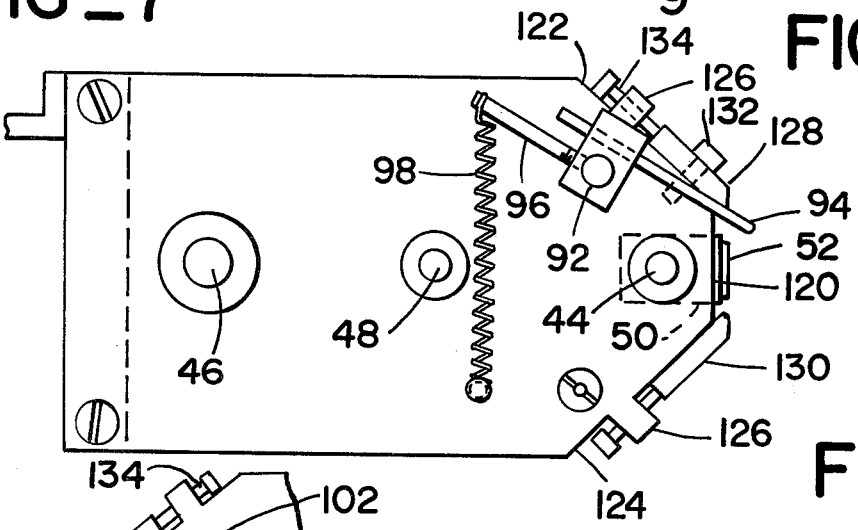
FIG. 6 is a fragmentary view in elevation of the in-line printing device showing the opposite side from FIG. 3.

A fourth shaft 92 mounted through and supported by the frame plates 40 and 42 is located between the first and third shafts. Fixed to one end of this fourth shaft and extending outwardly from it is a trigger member 94 adapted to be engaged by articles moving along the line of the labeling apparatus. Adjacent to the trigger member, as shown in FIG. 6, is an arm 96 that is fixed to the shaft 92 and projects rearwardly from it at a right angle. Attached to the end of the arm is a coiled spring 98 whose lower end is attached to the frame plate 40. Fixed to the other end of the fourth shaft that extends from the other plate is a pawl member 100. This pawl member is essentially a short arm that extends from an annular hub portion at one end which is attached to the shaft 92 by a set screw 102 so that its position on the shaft can be adjusted when necessary.

In the arrangement just described and as shown in the drawing (FIGS. 1–4) the trigger member 94 is located downstream and is adapted to be engaged and actuated by the last previous container to be printed. However, the trigger could also be located on an extension of the other end of its shaft 92 to engage a container upstream of the printing device, if such a modification was desirable.

Figure 5:
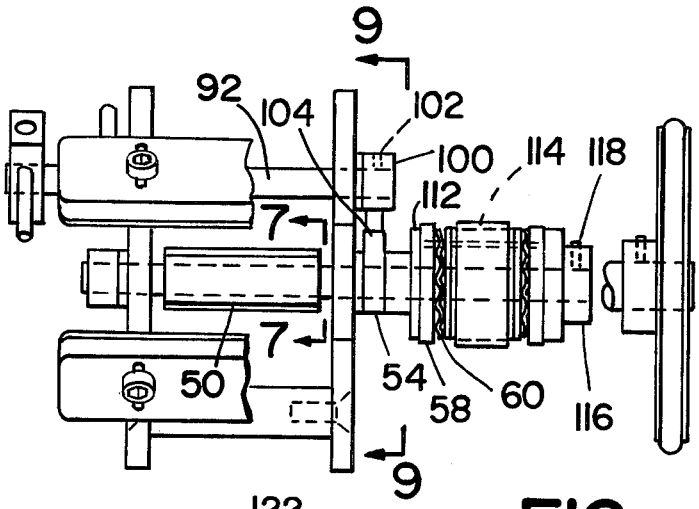
FIG. 5 is a front view in elevation (with portions broken away) of the in-line printing device shown in FIG. 3.
Figure 9:
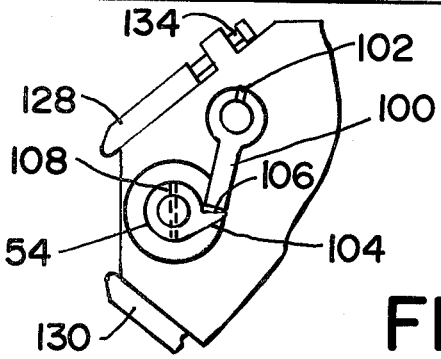
FIG. 9 is a fragmentary view in elevation taken along line 9—9 of FIG. 5 showing engagement of the pawl and cam member.
Figure 10:
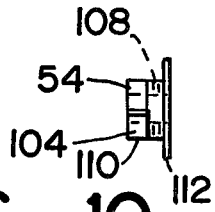
FIG. 10 is a detailed view of the cam member.
Figure 12:
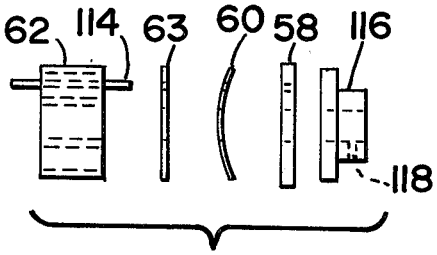
FIG. 12 is an exploded view showing said drive pulley with elements of the slip clutch.

The end of the pawl member 100 is normally urged toward the cam member 54 on the first shaft 44 by the force of the return spring 98 on the fourth shaft 92. As shown in FIGS. 9 and 10 the cam member has generally an outer cylindrical surface with a projecting portion 104 having a flat radial surface 106 on one side thereof that serves as a stop means. It is fixed to the shaft 44 by a roll pin 108 in an integral hub portion 110 having a flange 112 with a somewhat larger diameter. This latter flange bears directly against a friction disc 58 on the shaft 44 which presses a wafer spring 60 and a spacer 63 against one side of the pulley wheel 62 (FIG. 5). Another wafer spring, held by another friction disc on the shaft 44 is provided on the opposite side of the pulley wheel. The pulley wheel, the two friction discs 58 and the two wafer springs are all interconnected by a transverse pin 114 and held on the shaft by a retaining nut 116 having a flange and secured by a set screw 118 (See FIG. 12). The retaining nut is installed to provide sufficient axial compressive force so that the wafer springs are deformed to some slight degree. When the pawl 100 is not engaged with the stop surface 106 on the projecting arm 104 of the cam member 54, the cam member is free to rotate. Thus, the frictional engagement of the adjacent friction disc 58 and the flange 112 of the cam member 54 causes its rotation and rotation of the shaft 44. However, when the pawl 100 is momentarily engaged with the stop surface of the cam member, the cam member and the shaft 44 cease to move as the pulley 62 continues to rotate and slippage occurs between one friction disc and the cam member flange and the other friction disc and the end retainer nut 116. With the shaft stopped temporarily, the type holding mounting block 50 is held motionless in its preselected position as a moving container on the labeling apparatus conveyor engages the type and causes the printing of its label to take place.

Although the slip clutch and drive system just described is particularly efficient, other drive and slip clutch arrangements between a power supply means and the shaft 44 could be provided. For example, the clutch itself could be provided on the power output shaft and instead of the belt 64, friction wheels or meshed gears could be provided.

At its front end, each frame plate has a vertical edge surface 120 at its center and upper and lower sloping surfaces 122 and 124. Each sloping surface is provided with a lug 126 having a threaded bore whose axis is parallel to the sloping surface from which the lug projects. Supported on and extending across the upper sloping surfaces of the plate frame members is an upper eyebrow plate 128, and a similar plate 130 extends across the lower sloping surfaces. Each eyebrow plate is secured to the frame members by a first pair of machine screws 132, each one of which extends through a slot in the plate and into a threaded bore in the frame member. A second pair of machine screws 134 are anchored in one edge of each eyebrow plate and are threaded through the bores of the lugs 126 on the frame members. With the first screws loosened, the second screws can be turned to adjust the position of the eyebrow plates so that they extend outwardly to almost the same plane as the surface of the printing type when it is in its printing position. This provides a means for controlling the printing impression force exerted by a container on the type as it moves along against the outer edges of the eyebrow plates.

Figure 13:
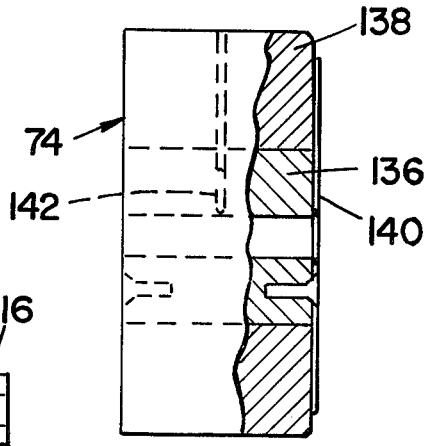
FIG. 13 is an enlarged view in section of the ink roller.
Figure 11:
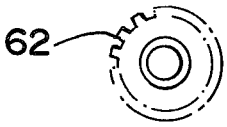
FIG. 11 is an end view of the drive pulley.

The ink supply roll 74 may be of any suitable type that is commercially available. Essentially, as shown in FIG. 13 it comprises a rigid hub 136 having an axial bore that forms a snug fit for the shaft 48. An outer annular roll 138 of ink impregnated fabric material is fitted around the hub and retained by annular side flange members 140 fixed to the hub by suitable fasteners. A set screw 142 is utilized to secure the hub to the shaft to assure that it rotates with the shaft with no slippage. The outside diameter of the ink roll is such that it makes contact with the printing type in its holder 50 as the latter rotates against the ink roll.

Figure 14:
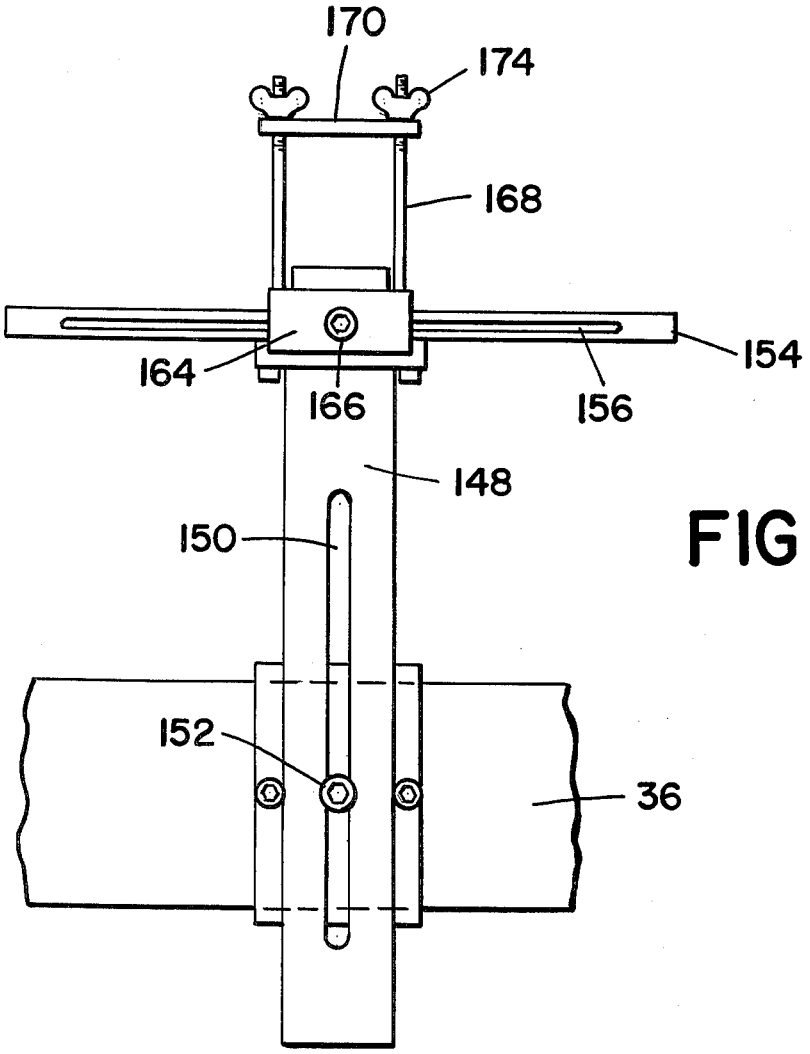
FIG. 14 is a front elevation in section showing the adjustable mounting system for the in-line printing device according to the invention.
Figure 15:
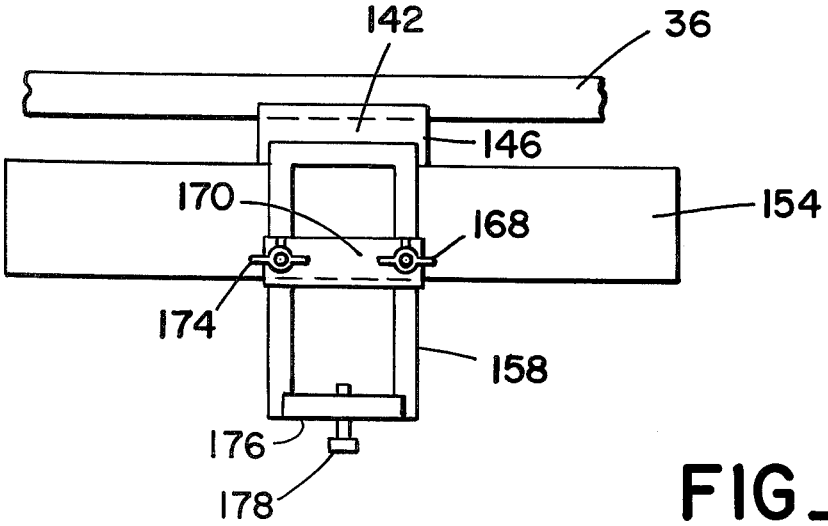
FIG. 15 is a top view of the mounting system of FIG. 14.

When the in-line printing device 20 is attached to a container label application apparatus it is preferably mounted to the latter's frame member 36 by the bracket assembly 38 so that its position can be adjusted within the desired limits. As shown in FIG. 1, this bracket assembly includes a frame mounting bracket 142 having upper and lower horizontal end flanges 144 that fit over the top and bottom of the apparatus frame member 36 and parallel and vertical side flanges 146. Situated between these side flanges, as shown in FIG. 14, is an elongated vertical "T" bar 148 that has an elongated slot 150 providing height adjustment for the printer. A bolt 152 threaded to the frame member 36 and extending through the bracket 142 and the slot 150, can be taken up to secure the "T" bar at its proper height. Fixed to the top of the "T" bar is a horizontal plate 154 having a side groove 156. Attached to this plate is an adjustable base member 158 for the printer having a transverse member 160 at one end with a hook-like edge flange 162 that fits along one side and under the plate 154. A similar transverse member 164, also having an edge flange, fits along the other side and under the plate and has a locking bolt 166 threaded therein which can be tightened into the side groove 156 of the plate. A pair of rods 168 are threadedly secured to opposite sides of the base member which are spaced apart so that they extend just outside and adjacent to the frame members 40 and 42 of the printer when it is supported on the base member. A tie bar 170 having spaced apart slots 172 or holes for the upper threaded ends of the rods 168 extends across the upper edges of the printer frame members. Wing nuts 174 are utilized on the rods to bear against the tie bar and hold the printer down against the base member 158. Across the rear end of the base member is an upright flange 176 within which is threadedly seated an adjustable stop nut 178 that is adapted to engage a transverse spacer extending between the printer frame members. Thus, the stop nut can be adjusted to position the printer, relative to the labeling apparatus barrier 26 before the wing nuts are tightened, when the printer 20 is initially installed.

In operation, the printing device 20 is capable of providing a precise printing function at a high cycle rate that will accommodate a wide range of container labeling apparatus. When installed on an operating labeling apparatus, the motor 84 is turned on for continuous operation at a preset speed that is controllable by the standard speed control unit 88. The output pulley 80 of the motor drives the pulley 76 of the second shaft 46 which turns its pulley and moves the non-slippage timing belt 64. This belt thus drives the pulley wheel 62 of the clutch unit 56 on the first shaft 44. The friction wheel 70 of the second shaft 46 is in constant engagement with the flywheel 72 of the shaft 48 and therefore drives it and the ink roll 74 at a constant rate. Before a moving container 22 on the labeling apparatus engages the trigger arm 94, the release spring 98 normally urges the pawl 100 into engagement with the stop surface 106 on the cam member 54. Thus, the first shaft 44, at this point, is not rotating and the print head 50 is held motionless between the eyebrow plates 128 and 130 ready to be engaged by a moving container. After this engagement occurs and printing on a container is accomplished, a container pushes against the trigger member and rotates the shaft against the force of the release spring 98. This simultaneously moves the pawl away from the cam member, allowing rotation of the first shaft and its attached print head. As this shaft moves, the print type 52 touches the ink supply roll 74 to pick up a fresh supply of ink. For high speed operation of the printer device the tangential velocity of the print head and the ink supply roll are made to be approximately equal, so that their engagement is more of a "kissing" action without any rubbing, and therefore the application of ink to the printing type is accomplished without smearing. For moderate or low speed operation, the ink roll need not be driven and therefore the friction wheel 68 with its ring 70 and the wheel 72 would not be utilized. However, in any event, the ink roll should have relatively low rotational inertia so that the application of ink to the type will take place without wearing.

As the print head with fresh ink rotates beyond the ink roll, the trigger arm 94 is free from contact with a container and thus the pawl is again urged by the spring 98 to engage the cam member 54. As this is done the type comes to its stationary position as the shaft stops and the clutch pulley wheel 62 continues to rotate as the friction discs 58 momentarily slip relative to the cam member flange 112 and the end retainer nut 116.

Thus, it is seen that as a continuously moving line of labeled containers move along to be printed, each container causes the first shaft and its printing head to be held motionless during printing on the container, and thereafter to rotate through contact with the inking roll to refresh the ink on the type. The printing device can recycle in the above manner as often as possible to accommodate a rapidly moving line of containers, and yet the printing on each container will be accomplished with fresh ink and without smearing or excess ink. The motor speed may be set by its controller to provide an output that is somewhat in excess of what is required by the speed of the container line and if the line speed is increased the motor speed and hence the printer speed can readily be increased to match it.

Although my printer device 20 is particularly adaptable for a stationary installation adjacent to a moving container line, as shown in FIGS. 1 and 2, it may also be useable for various other printing operations wherein the printer itself is reciprocated back and forth. Thus, in the previously described stationary installation, the trigger 94 of the printing device 20 is engaged and actuated by a moving container 22 on the production line. Now, if the device is to be used where there are no moving containers or if, for some reason, it is not desired to use a moving container to engage the trigger, a printing device 20*a* according to the invention, as shown schematiically in FIGS. 16 to 18 may be mounted, as on rails 180, to move towards and away from the object to be printed. The force for producing the reciprocating movement may be provided by some suitable actuator means 182 such as an air or hydraulic cylinder.

Figure 16:
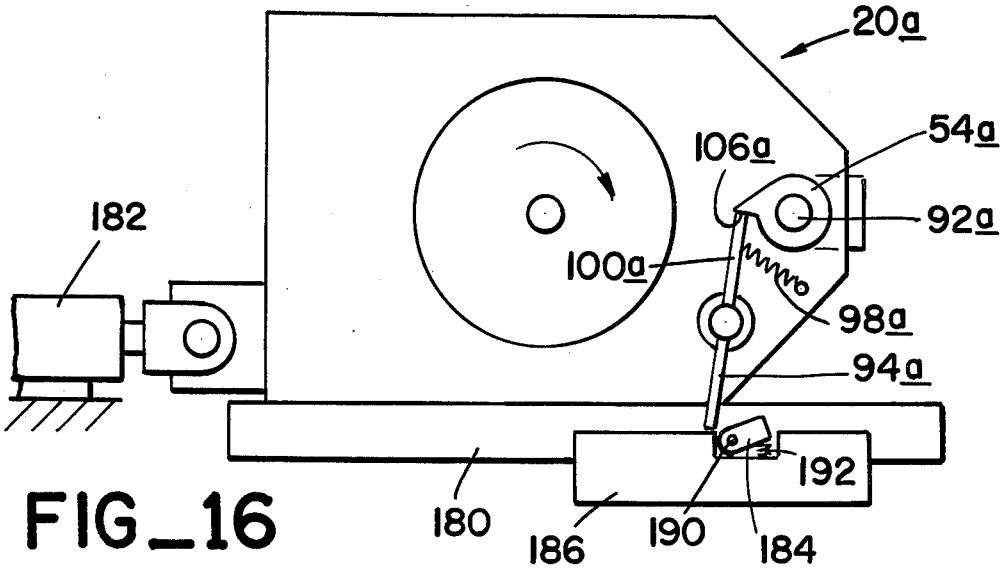
FIG. 16 is a schematic view in elevation showing an alternate installation arrangement for a printing device according to the present invention wherein the device, mounted for reciprocating operation, is shown in its rearward position.

As shown in FIG. 16, the movable printing device 20*a*, which may be similar in all over respects to the previously described printer 20, except that its trigger 94*a*, is positioned to engage a cam-like release member 184 mounted on fixed structure 186 adjacent the printer. A spring 98*a* is attached directly to the printer's pawl member 100*a* to urge it into engagement with the stop surface 106*a* of a cam member 54*a*. The trigger 94*a* which may be integral with the pawl member, as shown, (or located on the other end of the trigger shaft 92*a*) extends downwardly and terminates just above the surface of fixed structure 186 supporting the release member 184. This latter member may be in the form of an elongated lug that is flush with its surrounding surface when pushed into a recess 188. It is pivotally attached by a pin 190 at one end within the recess, and a spring 192 at its other end normally urges this end of the lug upwardly above the surrounding surface.

Figure 17:
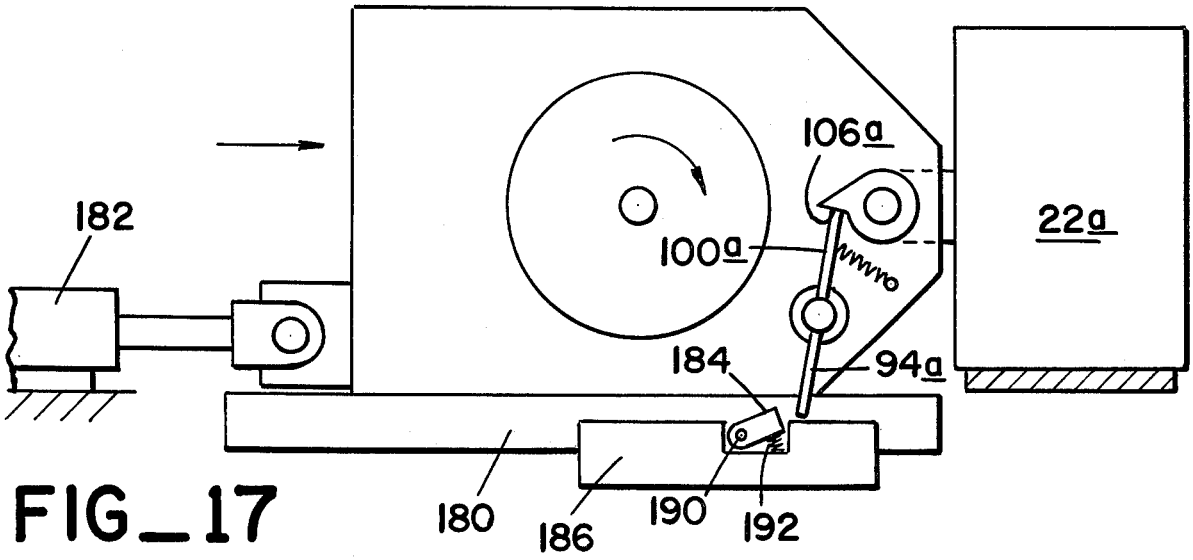
FIG. 17 is a view similar to FIG. 16 showing the device in its forward printing position.
Figure 18:
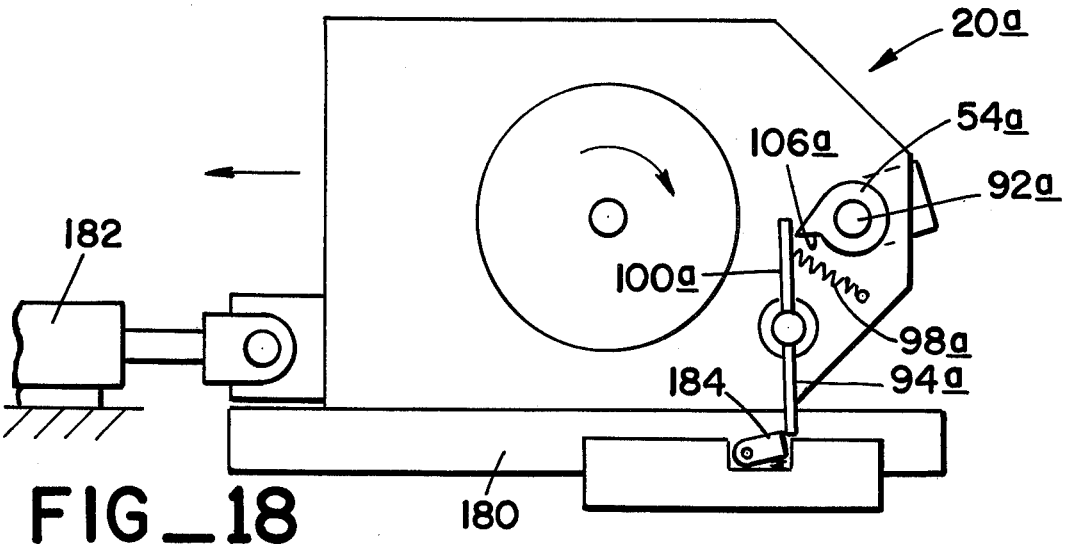
FIG. 18 is another view similar to FIG. 16 showing the device as it is being retracted and the pawl trigger is being actuated.

Thus, as shown in FIG. 16, when the printing device 20*a* is in its retracted position, its pawl member 100*a* is urged by its spring 98*a* into engagement with the printer cam member 54*a* so that the printer head and its type are held stationary in the printing position as the printer clutch slips. At this point, the release member 184 is held in its "up" position by its spring 192. In FIG. 17 the printer 20*a* has been pushed forward by its actuator means 182 and is shown in its printing position with the printer head type against an object 22*a* to be printed such as a container. As the printer moves forward, the trigger arm 94*a* depresses and moves over the release member. After the article has been printed, the printing device 20*a* is retracted by its actuator and as it moves rearwardly, as shown in FIG. 18, its trigger 94*a* engages the release member 184 which previously was pivoted upwardly from its recess by its spring 192. As the trigger 94*a* is released, the cam member 54*a* and its shaft 92*a* on the printer 20*a* is allowed to rotate, as previously described, to re-ink the printing type for the next printing cycle, and this re-inking occurs before the printer device is fully retracted. Thus, it is seen that my printing device, according to the present invention can be used for intermittent motion, where it moves forward to accomplish the printing action, as just described, as well as in the stationary container production line arrangement of FIGS. 1 and 2, where the container rolls over the type of the device.

To those skilled in the art to which this invention relates, many changes in construction and widely differing embodiments and applications of the invention will suggest themselves without departing from the spirit and scope of the invention. For example, the cam member 54 need not be limited to having one stop surface and the type block 50 could have two or more type holders, each corresponding to a particular stop surface on the cam member so that the type holding shaft could accomplish more than one printing operation in only one revolution. Thus, the disclosures and the description herein are purely illustrative and are not intended to be in any sense limiting.

I claim:

1. An apparatus for high speed printing on the curved sides of cylindrical containers, comprising:

a linear barrier plate having an aperture therein which is smaller than the containers to be imprinted;

conveyor means for urging the curved sides of the cylindrical containers against the barrier plate and simultaneously rolling the containers in single file along said plate, past said aperture;

a first rotatable shaft mounted adjacent said aperture on the opposite side of the barrier plate as the rolling containers, the axis of said shaft being perpendicular to the axes of said containers;

holding means carried by, and radially projecting from, the first rotatable shaft for retaining printing type at a distance far enough from the axis of said first rotatable shaft that said type will project into said aperture when aligned therewith, and will be rolled against by the surface of a container moving past the aperture;

continuous, unidirectional, rotary power means;

circular slip clutch means mounted coaxially with said first rotatable shaft for turning the shaft when such turning is not impeded;

transmission means for utilizing the output of said power means to continuously turn said clutch means;

a cam wheel carried by said first rotatable shaft, the cam surface of said wheel having a radial notch;

a pawl normally biased against said cam wheel so as to follow the cam surface when the first shaft turns and engage the radial notch, thereby arresting the turning of the shaft on each revolution, said pawl being so positioned that it arrests the turning of the shaft when said type holding means is aligned with the aperture in the barrier plate;

release means for withdrawing the pawl from the cam wheel notch, thereby permitting said first shaft to resume turning, said release means including a trigger mounted immediately adjacent to said aperture and protruding into the path of said file of containers so as to be tripped, thereby activating the release means, each time a container passes from in front of the aperture;

a second rotatable shaft mounted adjacent and parallel to said first shaft on the same side of the barrier plate as said first shaft;

and a cylindrical ink roll carried by said second shaft, the diameter of the ink roll being sufficiently large that the ink roll will be tangentially touched by printing type retained in said holding means during each revolution of said first shaft.

2. The apparatus of claim 1 additionally including second transmission means for utilizing the output of said power means to continuously turn said second rotatable shaft in the opposite direction of said first shaft at such a speed that the surface of the ink roll and the surface of printing type carried by said holding means will be moving at about the same speed when they come into tangential contact with one another.

3. The apparatus of claim 1 additionally including a pair of eyebrow plates mounted on the same side of the barrier plate as said first and second shafts, said eyebrow plates projecting through said barrier plate and terminating in front edges aligned with the direction of movement of the line of containers, said eyebrow plates being positioned above and below the point of contact between the containers and the printing type, so as to be contacted by the curved sides of said containers as they roll past the aperture, the extent of projection of the eyebrow plates being adjustable so as to adjust the pressure of said contact between the containers and the printing type.

4. The apparatus of claim 2 additionally including a pair of eyebrow plates mounted on the same side of the barrier plate as said first and second shafts, said eyebrow plates projecting through said barrier plate and terminating in front edges aligned with the direction of movement of the line of containers, said eyebrow plates being positioned above and below the point of contact between the containers and the printing type, so as to be contacted by the curved sides of said containers as they roll past the aperture, the extent of projection of the eyebrow plates being adjustable so as to adjust the pressure of said contact between the containers and the printing type.

5. The apparatus of claim 1 wherein said trigger of said release means is mounted immediately downstream of said aperture.

6. The apparatus of claim 1 wherein said trigger of said release means is mounted immediately upstream of said aperture.

* * * * *